United States Patent [19]

Henych et al.

[11] 4,040,596

[45] Aug. 9, 1977

[54] PROTECTIVE DEVICE FOR CASTING MOLDS

[75] Inventors: Ivo Henych; Erwin Fischer; Jürg Reist, all of Schaffhausen, Switzerland

[73] Assignee: Georg Fischer Aktiengesellschaft, Schaffhausen, Switzerland

[21] Appl. No.: 688,028

[22] Filed: May 19, 1976

[30] Foreign Application Priority Data

May 27, 1975 Switzerland ..... 6735/75

[51] Int. Cl.[2] ..... B22D 7/12

[52] U.S. Cl. ..... 249/117; 249/206

[58] Field of Search ..... 249/206, 204, 117

[56] References Cited

U.S. PATENT DOCUMENTS 2,907,083 10/1959 Shakely ..... 249/206 X

FOREIGN PATENT DOCUMENTS 754,573 8/1956 United Kingdom ..... 249/206

*Primary Examiner*—Robert D. Baldwin

*Attorney, Agent, or Firm*—Toren, McGeady and Stanger

[57] ABSTRACT

A device is provided for protecting the inner walls of casting molds, particularly molds of the permanent type which are filled by top pouring of the molten casting material thereinto, and for improving the surface quality of the castings formed in the mold. The device is formed from material which enables the device to be integrated into the casting formed in the mold and the protective device is configured with a bottom plate and a pair of laterally spaced upstanding side walls formed of sheet material. The protective device is placed in the bottom of the mold cavity and is located directly beneath the jet of molten casting material being poured into the mold. A wire lattice may be placed upon the protective device spaced above the bottom plate thereof or an upstanding tubular socket may be formed on the bottom plate.

3 Claims, 5 Drawing Figures

PROTECTIVE DEVICE FOR CASTING MOLDS

BACKGROUND OF THE INVENTION

The present invention relates generally to molding apparatus and more particularly to molds of the permanent type which are filled by top pouring of molten casting material thereinto. More specifically, the invention concerns a device for protecting the inner walls of the casting molds and for improving the surface quality of castings formed therein.

Prior art devices for the protection of permanent molds have been directed toward attempts to weaken the impact of the downwardly flowing molten casting jet during the casting operation in order to prevent, if possible, splashing of the molten melt. For example, from U.S. Pat. No. 2,572,654, it is known to utilize an insert having a number of upwardly projecting mandrels forming the bottom of a mold. Such inserts constitute a part of the mold and it is necessary that they be fitted exactly into a conical bottom opening before the casting operation. These inserts are rather expensive to manufacture and to use and they must subsequently be separated from the ingot which is formed.

Another prior art protective device for molds is known from German Pat. No. 1,194,102 which consists of a float, a pneumatic cushion arranged on the float and a wall surrounding the latter, all made of cardboard. At the start of the casting operation, the jet of casting material falls upon the cushion, burns it through after a short period of time and subsequently the non-metallic parts float upon the melt surface and are progressively destroyed. A disadvantage of this approach is that the combustion products of the non-metallic parts frequently lead to occlusions in the casting and to impurities particularly at its upper end. Additionally, these parts are very elaborate and expensive to manufacture and can be utilized only to a limited extent for more complicated cross-sectional configurations of the permanent mold.

The invention is directed toward overcoming the problems involved in protecting mold castings and toward the provision of simple and inexpensive means for achieving this result particularly in top pouring permanent molds. The invention aims toward enabling production of satisfactory castings having a clean surface and being devoid of non-metallic occlusions.

SUMMARY OF THE INVENTION

Briefly, the present invention may be described as including a protective device which consists essentially of a metallic member which is placed to bear upon the bottom of a mold cavity directly beneath the entrance to the cavity of the jet of molten casting material, with the protective device being composed of material permitting the device to remain within the casting as a part thereof after the casting has been removed from the mold. The protective device is configured as a generally channel-shaped member having a bottom plate with a pair of laterally spaced upwardly extending side walls formed from the sheet metal. The overall configuration of the metallic member is generally U-shaped in cross section and in one aspect of the invention a wire lattice or screen may be placed over the bottom plate to extend between the upper ends of the side walls.

Alternatively, the wire lattice may be bent into a curved configuration with opposite ends of the wire lattice being engaged between the inner sides of the upstanding side walls.

A further alternative involves the placement of an upstanding tubular socket upon the bottom wall of the metallic member.

The arrangement of the present invention is quite simple to use. It serves to replace the solidification thrust, which is missing in the impact region of the molten casting jet during the casting and thus avoids erosion of the mold bottom at this point. Additionally, there is avoided undesired currents and splashes against the wall of the mold in the initial casting stage. There is required no reworking of the casting.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
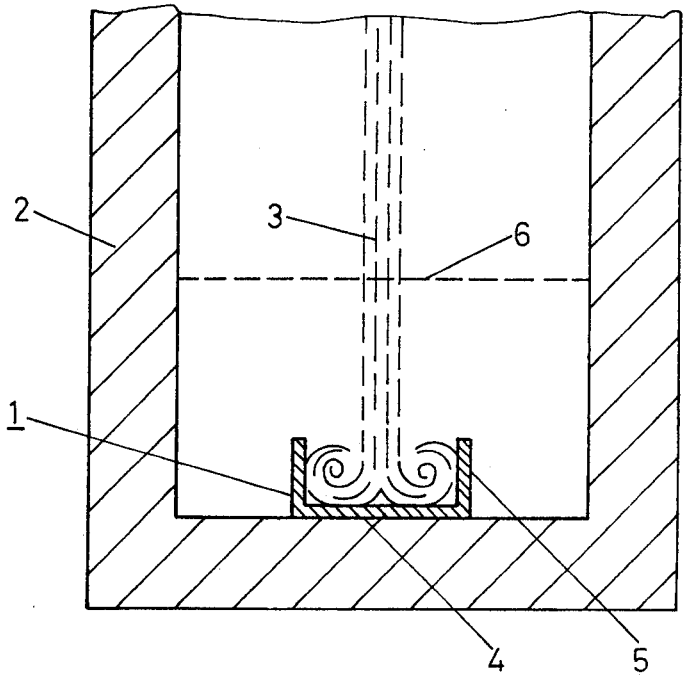
FIG. 1 is a sectional elevation taken through a casting mold having inserted therein the protective device of the invention and indicating the course of the molten casting jet.
Figure 2:
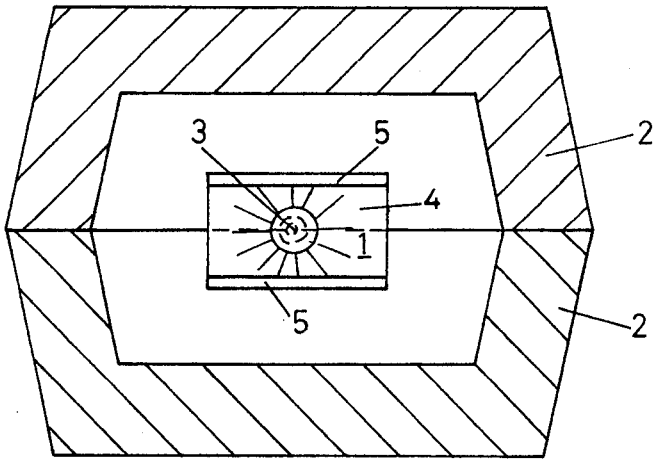
FIG. 2 is a horizontal section taken through the casting mold showing in top view the protective device according to FIG. 1.

Referring now to the drawings, wherein like reference numerals refer to similar parts throughout the various figures thereof, there is shown in FIGS. 1 and 2 a casting mold incorporating therein the protective device of the present invention. The device of the invention essentially comprises a metallic member 1 which is applied upon the bottom of a casting mold 2, particularly a metal mold of the permanent type which is filled by top pouring thereof. The molten casting material is introduced into the mold so that there is formed a falling casting jet 3 which impinges upon the metallic member 1. Thus, the metallic member 1 of the protective device of the invention is arranged and located within the mold 2 so that it preferably covers only a part of the mold bottom at the impact region of the falling casting jet 3.

The metallic member 1 includes a bottom plate 4 and a pair of laterally spaced upstanding side walls 5 formed of sheet metal. The overall configuration of the member 1 operates to damp the impact of the casting jet 3 and at the same time to deflect the impinging downwardly flowing casting material in order to prevent lateral splashing thereof. The metallic member 1 is composed of material which will enable the member 1 to remain upon the bottom of the mold during the casting operation and to withstand the impact of the jet 3 for a sufficiently long period of time until an adequate height of charge 6 of the melt has been formed. At this point, the upper level of charge 6 will receive the subsequently falling casting jet 3 which will be introduced into the casting mold with a progressively diminishing length of its vertical flow path.

Figure 3:
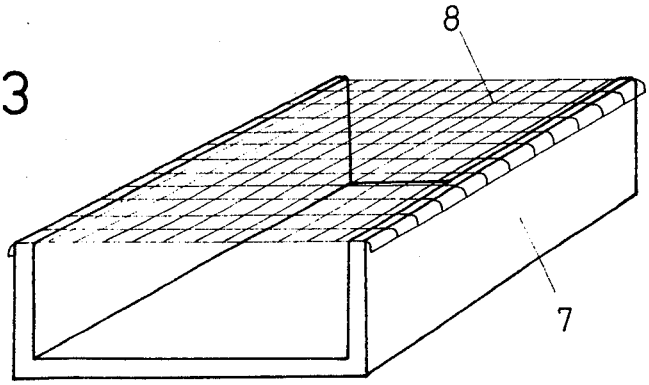
FIGS. 3–5 are perspective views each showing a different embodiment of the present invention.

A further embodiment of the invention is represented in FIG. 3 wherein a U-shaped channel section 7 is shown having a wire lattice 8 arranged to bear upon the uspstanding side walls so that the lattice 8 is positioned over the bottom plate 4 of the protective member and spaced therefrom by a distance equivalent to the height of the side walls.

Figure 4:
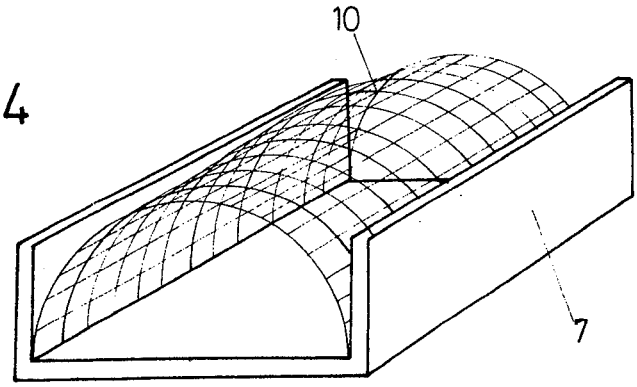

A further embodiment of the invention is depicted in FIG. 4 which likewise comprises a U-shaped section 7 wherein a wire lattice 10 is provided having a curved configuration which extends over the bottom plate of the protective device and which is loosely clamped between the upstanding side walls in the manner indicated in FIG. 4.

The wire lattices 8 and 10 provide the function of braking the downpouring jet 3 during its passage into the mold and to effect an even distribution thereof while also preventing upward splashing.

Figure 5:
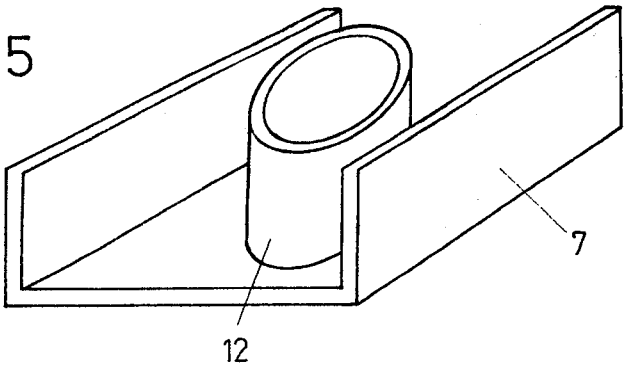

A further embodiment of the invention is depicted in FIG. 5 wherein the U-shaped section 7 is provided, as shown, with an upstanding tubular socket 12. Although a single tubular socket 12 is shown in the embodiment of FIG. 5, a plurality of such sockets may, alternatively, be provided. For example, a pair of socket 12 may be provided in a side-by-side relationship and they may have either the generally circular cross section depicted in FIG. 5 or they may otherwise comprise an angular, for example, a square, cross-sectional configuration.

The upwardly extending side walls 5 of the metallic member 1 may be formed integrally with the bottom plate 4 or they may be welded thereto. The metallic member may be made of the same material as the material of the casting melt which is introduced into the mold or it may be of a different material which dissolves at least partially within the melt or which becomes welded thereto.

If, on the other hand, a metal is selected which consists of a material which is not capable of being integrated with the casting melt, the upwardly extending sheet metal side walls 5 should be preferably arranged at an oblique angle relative to the bottom plate 4. With this design, the metallic member may be safely anchored within the solidified casting.

For castings of cast iron or steel, metallic members of steel or iron may be used with advantage, for example, in the form of drawn or canted sections. Preferably, the walls of the metallic member 1 should be of a thickness of between 0.5 and 5 mm. Wall thicknesses below 1 mm have the advantage that the metallic parts are economical to produce and will be readily melted by the casting melt. The height of the upwardly extending sheet metal side walls 5 should preferably be between about 0.5 to 1 times the width of the bottom plate 4.

If the metallic member must be fixed in a desired position within the mold, this may be achieved, for example, by magnetically holding the member in place or by applying thereto a cinder paste or a black wash.

With the device of the present invention, several advantages may be achieved. The metallic member 1 may be completely integrated into the casting which is formed and need not be removed after solidification since it will be formed flush with the bottom surface of the casting. The protective device of the invention produces no combustion gases and no undesired occlusions. Furthermore, there is permitted continuous monitoring or control for automated manufacture. The protective device of the invention is very economical to produce and simple to use even where only small quantities are required. Additionally, the device exhibits versatility in that it may also be used for permanent molds having more complex cross sectional configurations.

While specific embodiments of the invention have been shown and described in detail to illustrate the application of the inventive principles, it will be understood that the invention may be embodied otherwise without departing from such principles.

We claim:

1. A device for protecting the inner walls of a casting mold, particularly in a mold of the permanent type which is filled by top pouring of molten casting material thereinto, and for improving the surface quality of castings formed in said mold, said mold defining a mold cavity including a bottom, said device comprising a metallic member positioned upon said bottom of said mold cavity and located to be directly impinged by molten casting material poured into said mold, said metallic member being essentially composed of material to effect integration of said metallic member into the casting formed in said mold, said metallic member configured with a bottom plate and a pair of laterally spaced upstanding side walls formed of sheet metal, and a wire lattice arranged above said bottom plate and spaced a distance therefrom.

2. A device according to claim 1 wherein said metallic member is formed in a generally U-shaped configuration with said side walls upstanding from said bottom plate on opposite sides thereof, said device further including said wire lattice extending across said side walls between the upper ends thereof.

3. A device according to claim 1 wherein said metallic member is formed in a generally U-shaped configuration with said side walls upstanding from said bottom plate on opposite sides thereof, said device further including said wire lattice bent in a curved configuration and engaged between said side walls to extend over said bottom plate.

* * * * *